US008074721B2

(12) United States Patent
Guven et al.

(10) Patent No.: US 8,074,721 B2
(45) Date of Patent: Dec. 13, 2011

(54) METHOD FOR CONTROLLING A DOWNHOLE TOOL WITH A LINEARLY ACTUATED HYDRAULIC SWITCH

(75) Inventors: Oguzhan Guven, Houston, TX (US); Ricardo Martinez, Spring, TX (US); Steven L. Anyan, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 298 days.

(21) Appl. No.: 12/415,501

(22) Filed: Mar. 31, 2009

(65) Prior Publication Data

US 2010/0212882 A1 Aug. 26, 2010

Related U.S. Application Data

(60) Provisional application No. 61/155,005, filed on Feb. 24, 2009.

(51) Int. Cl.
*E21B 34/10* (2006.01)

(52) U.S. Cl. ..... 166/375; 166/319; 166/334.2; 137/861

(58) Field of Classification Search ..... 137/861, 137/597; 166/153, 319, 332.3, 374, 386, 166/334.2, 375; 251/230, 315.01, 304
See application file for complete search history.

(56) References Cited

U.S. PATENT DOCUMENTS

| | | | | |
|---|---|---|---|---|
| 2,173,531 | A | 9/1939 | De Long | |
| 3,191,628 | A | 6/1965 | Kirkwood et al. | |
| 3,370,612 | A * | 2/1968 | Holl | 137/625.47 |
| 3,780,809 | A * | 12/1973 | Ayers et al. | 166/374 |
| 4,509,405 | A | 4/1985 | Bates | |
| 4,813,749 | A * | 3/1989 | Cilles | 299/80.1 |
| 4,896,722 | A | 1/1990 | Upchurch | |
| 4,915,168 | A | 4/1990 | Upchurch | |
| 4,915,168 | A | 9/1994 | Upchurch | |
| 5,950,733 | A | 9/1999 | Patel | |
| 6,170,571 | B1 | 1/2001 | Ohmer | |
| 6,182,764 | B1 | 2/2001 | Vaynshteyn | |
| 6,523,613 | B2 | 2/2003 | Raysiguier et al. | |
| 6,536,529 | B1 | 3/2003 | Kerr et al. | |
| 7,182,139 | B2 | 2/2007 | Raysiguier et al. | |
| RE39,583 | E | 4/2007 | Upchurch | |
| 7,306,043 | B2 | 12/2007 | Toekje et al. | |
| 7,337,850 | B2 | 3/2008 | Contant | |
| 7,503,385 | B2 | 3/2009 | Tips et al. | |
| 2007/0056745 | A1 | 3/2007 | Contant | |
| 2008/0164027 | A1 | 7/2008 | Sanchez | |
| 2009/0065218 | A1 | 3/2009 | Loretz et al. | |

FOREIGN PATENT DOCUMENTS

GB 2268999 A * 1/1994

* cited by examiner

*Primary Examiner* — David Bagnell
*Assistant Examiner* — Richard Alker

(57) ABSTRACT

A switching apparatus, system, and method configured to operate at least a dual line downhole tool via a single pressure source are provided. The switching apparatus may comprise a housing configured to contain a switching piston actuated by a fluid pressure source. The apparatus may further contain a switching valve comprising a first and second coupling passageway coupled to a switching valve housing comprising four ports. The switching piston may actuate the switching valve, alternating the coupling between a first configuration in which the four ports are communicatively coupled into two sets of ports and a second configuration in which the four ports are communicatively coupled into an alternate two sets of ports. The first configuration may configure the fluid pressure source to actuate the downhole tool in a first manner and the second configuration may configure the fluid pressure source to actuate the downhole tool in a second manner.

19 Claims, 3 Drawing Sheets

METHOD FOR CONTROLLING A DOWNHOLE TOOL WITH A LINEARLY ACTUATED HYDRAULIC SWITCH

RELATED APPLICATIONS

This application claims the benefit of U.S. Provisional Application No. 61/155,005, filed Feb. 24, 2009, the contents of which are herein incorporated by reference.

BACKGROUND

1. Field of the Invention

The present invention relates generally to the control of downhole tools, and more particularly to single control line actuation of downhole tools.

2. Description of the Related Art

The following descriptions and examples are not admitted to be prior art by virtue of their inclusion in this section.

Many hydraulically actuated downhole tools require two dedicated control lines to apply a pressure differential across a piston seal in order to translate an actuating device such as a mandrel or other similar component. This actuating device may be coupled or attached to a valve, such as a barrier or sliding sleeve valve, among others, in addition to other downhole tools or devices. For example, the valve may separate two zones of a formation or control the flow of fluid from the formation into the production tubing. However, the use of two individual control lines may add to the overall complexity of a downhole completion and occupy an increasingly limited space in a downhole environment. In addition, two control lines may raise the risk that one or both of the control lines is damaged during run in and/or operation. If there is a threshold level of pressure existing in the control lines, a leak in one control line may cause an inadvertent actuation of a downhole device as the threshold pressure from the other line is applied across the piston. Such a situation may significantly increase the risk of a catastrophic event, such as the unintentional discharge of hydrocarbons into the environment resulting from the inadvertent opening a safety valve for example. A single control line may provide increased levels of efficiency and reliability along with decreased amounts of complexity and space utilization.

SUMMARY

In accordance with an embodiment of the invention, a switching apparatus may comprise a housing configured to contain a switching piston actuated by a fluid pressure source and a switching valve comprising a first and second coupling passageway. In addition, the switching apparatus may comprise a switching valve housing coupled with the switching valve and comprising four ports. The switching piston may actuate the switching valve, alternating the coupling between a first configuration in which the four ports are communicatively coupled into two sets of ports via the first and second coupling passageways, and a second configuration in which the four ports are communicatively coupled into an alternate two sets of ports via the first and second coupling passageways. The first configuration may configure the control system to actuate a downhole tool in a first manner and the second configuration may configure the control system to actuate the downhole tool in a second manner.

In accordance with another embodiment of the invention, a control system may be configured for actuating a downhole tool. The control system may comprise a fluid pressure source coupled to a control line and a control line splitter splitting the fluid pressure into a bypass line and a switching line. In addition, the control system may comprise a switching assembly coupled to the switching line. The switching assembly may include a switching piston, a switching valve comprising a first and second coupling passageway, and a switching valve housing coupled with the switching valve and configured to be coupled to a first and second operating line, a venting port, and the bypass line. The switching piston may actuate the switching valve between two or more positions, alternating the coupling of the first and second operating lines with the venting port and the bypass line via the first and second coupling passageways. Coupling the first operating line with the bypass line configures the control system to actuate the downhole tool in a first manner and coupling the second operating line with the bypass line configures the control system to actuate the downhole tool in a second manner.

Other or alternative features will become apparent from the following description, from the drawings, and from the claims.

BRIEF DESCRIPTION OF THE DRAWINGS

Certain embodiments of the invention will hereafter be described with reference to the accompanying drawings, wherein like reference numerals denote like elements. It should be understood, however, that the accompanying drawings illustrate only the various implementations described herein and are not meant to limit the scope of various technologies described herein. The drawings are as follows.

DETAILED DESCRIPTION

Figure 1:
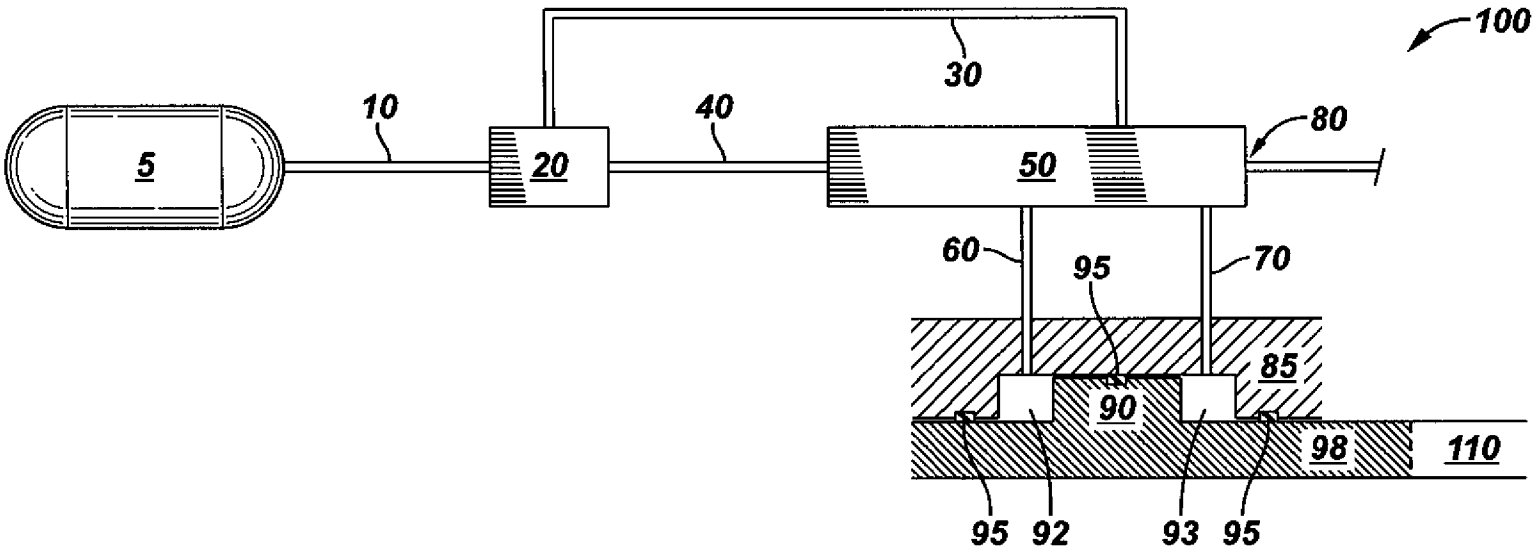
FIG. 1 is a partial schematic of a switching mechanism applied to a downhole device, in accordance with an embodiment of the invention.

In the following description, numerous details are set forth to provide an understanding of the present invention. However, it will be understood by those of ordinary skill in the art that the present invention may be practiced without these details and that numerous variations or modifications from the described embodiments may be possible.

In the specification and appended claims: the terms "connect", "connection", "connected", "in connection with", "connecting", "couple", "coupled", "coupled with", and "coupling" are used to mean "in direct connection with" or "in connection with via another element"; and the term "set" is used to mean "one element" or "more than one element". As used herein, the terms "up" and "down", "upper" and "lower", "upwardly" and "downwardly", "upstream" and "downstream"; "above" and "below"; and other like terms indicating relative positions above or below a given point or element are used in this description to more clearly describe some embodiments of the invention.

Illustrative embodiments of the claimed invention may generally relate to the hydraulic actuation of downhole tools using a single hydraulic control line. In lieu of two dedicated control lines, some embodiments may utilize a switching assembly coupled to the single control line and configured to direct the hydraulic pressure signal from the single control line. In some cases, the hydraulic pressure signal may originate at or near the surface of a well system, while in other cases, the hydraulic pressure signal may originate closer to the downhole device controlled by the hydraulic pressure signal. For example, in embodiments in which the hydraulic pressure signal originates closer to the downhole device, the hydraulic pressure signal may be the result of a signal converter, such as an electro-hydraulic converter for example. An electro-hydraulic converter may receive an electrical signal and transform the electrical signal into a hydraulic signal output (e.g., such as through the powering of a hydraulic pump in order to pressurize the system). Of course, embodiments of the claimed invention may not be limited to this one example, many different types of signal converters may exist and these converters may function to transform acoustic, electric, optic, or mechanical signals into hydraulic signals.

Once the hydraulic pressure signal is established and communicated to a location proximate to the downhole device, embodiments of the claimed invention may comprise a downhole switching assembly to divert or direct a single hydraulic pressure signal (i.e., either pressure or flow, for example) to a preferred side of a double acting actuating piston coupled to the downhole tool. Embodiments of the switching assembly may functionally convert a single dedicated control line or source of hydraulic pressure to provide the functionality similar to that achieved by dual control lines. In some cases, linear hydraulic actuation resulting from the input of a single hydraulic pressure signal may be converted to the rotation of a ball valve, for example, in which the fluid flow from the single control line is intentionally directed or diverted to among two or more locations, such as either side of an actuating piston among others.

In some embodiments, pressure from a single dedicated hydraulic control line may further linearly actuate a switching piston. The linear action of the switching piston may be converted to a rotating action through the use of a linear to rotational interface, such as a screw mechanism, for example, in some cases comprising a rod with a helical groove and an alignment guide, among other methods (e.g., such as a ratcheting rack and pinion). A valve, such as a rotatable ball valve or other type of valve, may be coupled to the rod. The valve may be actuated between two or more positions, such as by rotating through a fixed, predetermined amount (e.g., such as 45° or 90°, among other angles according to the requirements of a particular application) resulting from each full stroke or cycle (e.g., a forward and backward movement) of the switch assembly's switching piston.

For example, in the case of moving the valve between two predefined positions, at each position of the valve the flow or pressure in a split line (e.g., a bypass line) from the single source of hydraulic pressure signal may be delivered to one side of a double acting actuating piston coupled to an actuator of a downhole tool (e.g. such as a surfaced controlled isolation valve or a flow control valve, among other tools). The pressure on the opposing side of the double acting actuating piston may be vented concurrently through a separate passageway in the valve. When the single source of hydraulic pressure signal is bled off, the switch assembly's switching piston may be retracted due at least in part to the biasing of a resilient device, such as a mechanical or gas spring, for example. In some cases, the further rotation of the valve, such as the back rotation of the ball valve, may be prevented or inhibited through the use of a clutch mechanism that disengages when the switching piston is being retracted. Accordingly, the valve may be rotated through a single cycle or full stroke of the switching piston, and in some cases, a single translating direction of the single cycle or full stroke of the switching piston.

Referring generally to FIG. 1, an example of a schematic is shown illustrating a downhole control system 100 deployed according to an exemplary embodiment of the claimed invention. The downhole control system 100 may comprise a single source of fluid pressure 5 (e.g., such as hydraulic fluid), generated either at the surface or at some point below the surface. The single source of fluid pressure 5 may be coupled to a line splitter 20 via a source control line 10. The source control line 10 may be used to provide an input into the line splitter 20. The line splitter 20 may split the single source of fluid pressure 5 into two separate control lines, such as a bypass line 30 and a switching line 40 for example. In some embodiments, the two separate control lines 30, 40 may experience relatively the same pressure level at relatively the same point in time. In other embodiments, a delay mechanism, such as a choke or metered orifice may be used to delay or alter the timing of the build up in pressure of one or both of the control lines 30, 40.

The bypass line 30 and the switching line 40 may be coupled to a switch assembly 50 (shown here as a hydraulic switch assembly). In this illustrative embodiment, the bypass line 30 may be used to provide the actuation power to one side or another of an actuating piston 90 (shown here as an integral portion of a mandrel 98). The bypass line 30 may be coupled to one surface or another of the actuating piston 90 via first and second operating lines 60 and 70. Due to the actuation of the switch assembly 50, the bypass line 30 may be communicably coupled to one of the first and second operating lines 60 and 70. The other of the first and second operating lines 60 and 70 may be vented via a venting port 80, shown in this embodiment as being coupled to a vent line, but not limited to this one example. The venting port 80 may allow hydraulic pressure to be released to the annulus, a storage compartment, or the interior of the production tubing.

For example, when the bypass line 30 is coupled with the first operating line 60, the second operating line 70 may be coupled with the venting port 80. Application of hydraulic pressure via the bypass line 30 and the first operating line 60 to the first chamber 92 would result in the actuating piston 90 being forced to translate to the right (as seen in this figure). As the actuating piston 90 and mandrel 98 assembly translates, fluid from the second chamber 93 on the opposing side of the actuating piston 90 may move through the second operating line 70 and through the venting port 80. Actuating the switch assembly 50 such that the bypass line 30 is alternatively coupled with the second operating line 70 and the first operating line 60 is coupled with the venting port 80, may result in the actuating piston 90 and mandrel 98 assembly being forced to translate in an opposite direction (i.e., to the left) when hydraulic pressure is applied to the system.

Hydraulic pressure from the single source of fluid pressure 5 may be applied concurrently to the bypass line 30 and the switching line 40. However, as described previously, in some embodiments, the rise in pressure levels of each line 30, 40 may be either relatively simultaneous or separated by a quantity of time. Increasing the pressure of the switching line 40 may result in the actuation of the switching assembly 50, such as via the operation of a switching piston (not shown and described in detail later) within the switching assembly 50. Operation of the switching piston may alternate the communicable coupling of the bypass line 30 with one or the other of the first and second operating lines 60 and 70. Accordingly, the single bypass line 30 may then be able to apply fluid pressure to either side of an actuating piston 90 depending upon the particular configuration of the switching assembly 50. The switching assembly 50 may be able to provide for an unlimited amount of cycling of the switching piston The actuating piston 90 may be a separate component, coupled to the downhole device 110 through one or more intermediate components, or the actuating piston 90 may be an integral portion of another component. In this illustrative embodiment, the actuating piston 90 is formed on an exterior surface of a mandrel 98 between the mandrel 98 and an outer perimeter 85 (e.g., tubing, casing, or outer housing of downhole device, among others) of a well system (only a portion of the mandrel 98 and outer perimeter 85 are shown in order to simplify the description). The mandrel 98 may be configured to translate relative to the outer perimeter 85. In addition, the actuating piston 90 may be sealed through the use of one or more seals 95 (three are shown), separating and containing the hydraulic pressure source provided by either the first or second operating lines 60, 70, into a first chamber 92 and a second chamber 93. The first chamber 92 and the second chamber 93 may be provided on either side of the actuating piston 90. When the first chamber 92 fills with fluid, the second chamber 93 correspondingly vacates fluid, and when the second chamber 93 fills with fluid, the first chamber 92 vacates fluid. The correspondence between filling and vacating may help to prevent fluid locking of the actuating piston 90.

Figure 2A:
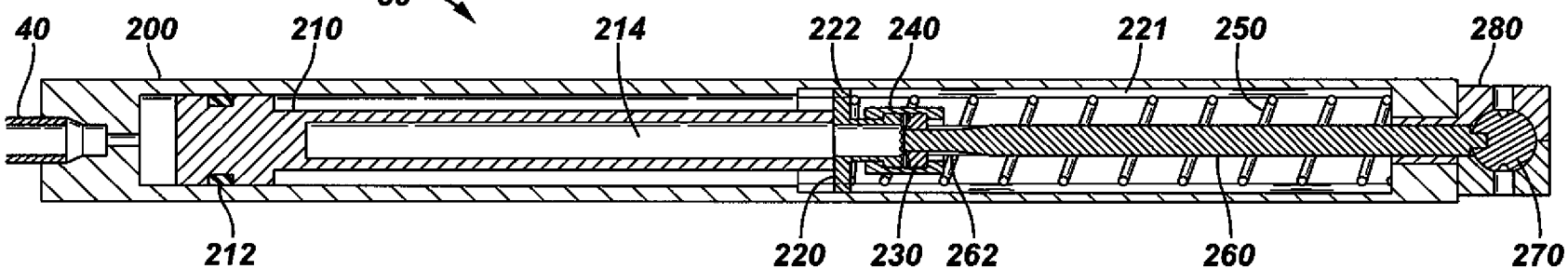
FIG. 2A is a cross-sectional side view of a switching assembly, in accordance with an embodiment of the invention.

Turning now to FIGS. 2A-2E, these drawings are cross-sectional and perspective views of various components of an illustrative embodiment of a switching assembly 50. As shown in FIG. 2A, the switching assembly 50 may comprise a housing 200 coupled to an input port at one end, for example. The input port may in turn be coupled with a switching line 40 to provide a source of actuating fluid. The housing 200 may comprise an interior chamber configured to translatably and sealably accommodate a switching piston 210. The switching piston 210 may be sealably coupled to an interior surface of the interior chamber of the housing 200 via one or more seals 212. In some embodiments, the switching piston 210 may comprise a cavity 214 configured to accommodate a rod 260 (detailed later). The distal end of the switching piston 210 (i.e., away from the input port) may abut a clutch coupling 220.

Figure 2B:
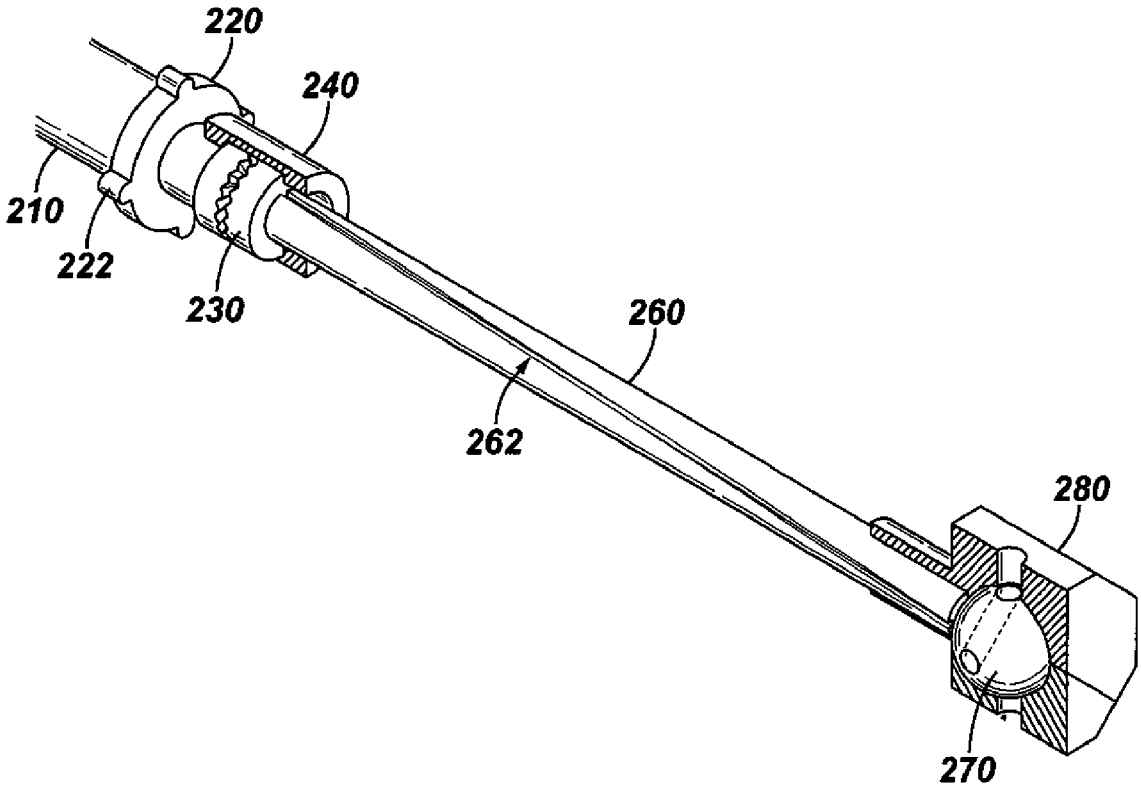
FIG. 2B is a partial cross-sectional perspective view of a switching assembly, in accordance with an embodiment of the invention.
Figure 2C:
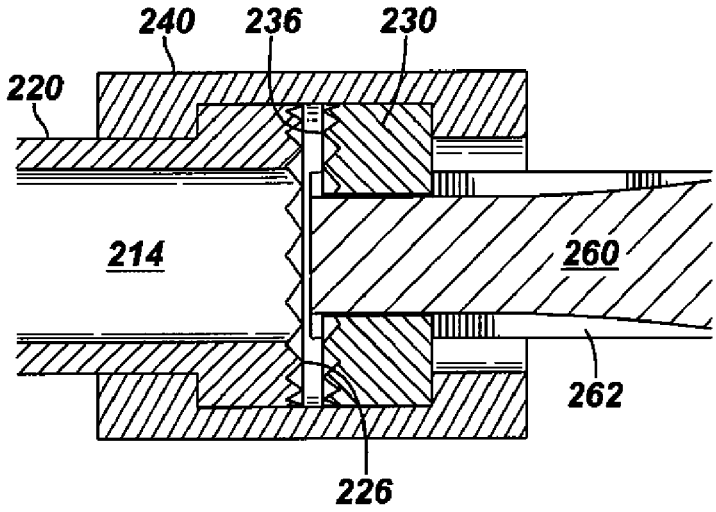
FIG. 2C is an enlarged cross-sectional side view of a clutch mechanism, in accordance with an embodiment of the invention.
Figure 2D:
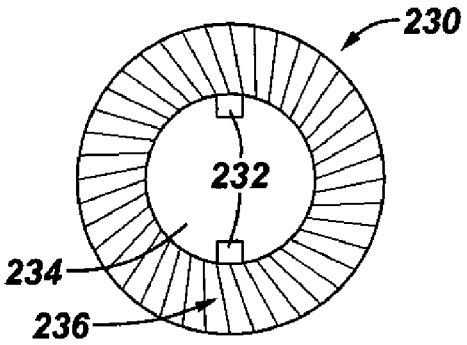
FIG. 2D is a cross-sectional top view of a clutch nut, in accordance with an embodiment of the invention.
Figure 2E:
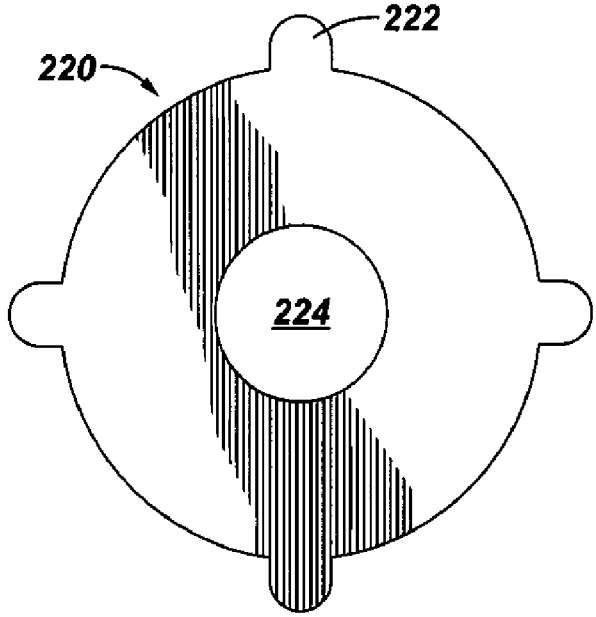
FIG. 2E is a top view of a clutch coupling, in accordance with an embodiment of the invention.

In some situations, embodiments of the clutch coupling 220 may be integrally formed with the switching piston 210, while in other situations, embodiments of the clutch coupling 220 may be configured as a component separate from the switching piston 210. The clutch coupling 220 may be coupled to the switching piston 210 or configured to move relative (e.g., such as rotationally, or axially) to the switching piston 210. The clutch coupling 220 may be accommodated within the housing 200 and configured to translate within the interior camber of the housing 200. However, in this illustrative embodiment, during translation the clutch coupling 220 may be rotationally fixed relative to the interior of the housing 200. For example, the clutch coupling 220 may comprise one or more clutch coupling protrusions 222 or tabs (four are shown in FIGS. 2B and 2E) extending into corresponding housing grooves 221 formed within the interior surface of the housing 200. As the clutch coupling 220 translates along a portion of the length of the housing 200, the interaction of the clutch coupling protrusions 222 and the housing grooves 221 may control the rotation of the clutch coupling 220 relative to the housing 200.

The clutch coupling 220 may further comprise an clutch coupling orifice 224 configured to translatably accommodate the outer circumference of the rod 260. One surface (i.e., the proximal surface or left surface) of the clutch coupling 220 may be configured to abut the switching piston 210 while the interacting coupling surface 226 (i.e., the distal surface or right surface) of the clutch coupling 220 may be configured to abut a clutch nut 230. As shown in FIG. 2C, one or both surfaces of the clutch coupling 220 may comprise engagement structures such as serrations, teeth, grooves, protrusions, cavities, or surface roughness, among others, to interact with the opposing surface of the abutting component (only the interacting coupling surface 226 is shown here as having such structures).

The clutch nut 230 (referring generally to FIG. 2D) may comprise a clutch nut orifice 234 configured to translatably accommodate the outer circumference of the rod 260. However, unlike some embodiments of the clutch coupling 220, the clutch nut orifice 234 may comprise one or more clutch nut protrusions 232 configured to be translatably accommodated within corresponding rod grooves 262 (see FIG. 2C) located within the outer circumference of the rod 260. The interaction between the clutch nut protrusions 232 and the rod grooves 262 of the rod 260 may control the relative rotation between the clutch nut 230 and the rod 260. For example, in the case in which the rod 260 comprises helically cut grooves, the relative rotation between the clutch nut 230 and the rod 260 may be 45° or 90°, among other predetermined relative rotational amounts, as the clutch nut 230 translates along the length of the rod 260.

One surface of the clutch nut 230 may be configured to abut the interacting coupling surface 226 of the clutch coupling 220, the interacting clutch nut surface 236. One or both of the interacting coupling surface 226 and the interacting clutch nut surface 236 may be configured to engage the opposing surface. However, embodiments of the claimed invention may not be limited by the type of engagement selected. In some cases, opposing serrations may be provided, allowing for relative rotation between the clutch coupling 220 and the clutch nut 230 in one rotational direction (e.g., due to a slipping or ratcheting effect), while inhibiting or preventing relative rotation in the opposing rotational direction (e.g., due to engagement of the serrations). Of course, other forms of friction enhancing methods, gears, teeth, protrusions, cavities, and surface configurations, among others, may be used to control the relative rotation and/or direction of relative rotation of the clutch coupling 220 with respect to the clutch nut 230.

The clutch coupling 220 and the clutch nut 230 may be comprised within a clutch housing 240. The clutch housing 240 may be configured to allow the selective engagement of the clutch coupling 220 and the clutch nut 230. As shown in this illustrative embodiment (referring generally to FIG. 2C), one end of the clutch coupling 220 (e.g., the distal end comprising the interacting coupling surface 226) may be contained within an interior of the clutch housing 240 along with the clutch nut 230. However, other embodiments may not be limited to this exemplary configuration. Alternative configurations, including, but not limited to, making the clutch housing 240 integral to either the clutch coupling 220 or the clutch nut 230, and having one, both or neither of the clutch coupling 220 or the clutch nut 230 extend beyond the interior of the clutch housing 240, among others.

The clutch housing 240 may substantially retain the clutch coupling 220 and the clutch nut in relative axial alignment, while allowing for independent rotation of each component and in some cases, slight translation of one component relative to another. The clutch housing 240 may be configured to allow the interacting coupling surface 226 to engage and disengage from the interacting clutch nut surface 236. In some cases, a resilient device may be incorporated to bias the interacting surfaces 226, 236 to a disengaged state. For example, a mechanical wave spring may be placed in corresponding grooves provided on the interacting surfaces 226, 236 to provide a level of separation between the interacting surfaces 226, 236 (not shown).

Some embodiments of the switching assembly 50 may comprise a rod 260. The rod 260 may be contained within the interior of the housing 200 and configured to rotate relative to the housing 200. Further, the rod 260 may be relatively translatably fixed in position with regard to the housing 200. As shown in FIG. 2A, the rod 260 may be translatably coupled with the clutch nut 230 and rotatably coupled with the housing 200+The rod 260 may also be coupled with a valve, such as the ball valve 270 shown in this illustrative embodiment. Rotation of the rod 260 may result in corresponding movement of the valve. For example, the rod 260 may be rotatably fixed relative to the ball valve 270 such that rotation of the rod 260 results in a corresponding rotation of the ball valve 270.

The rod 260 may comprise cut rod grooves 262 or other engagement mechanisms configure to control the interaction between the rod 260 and the clutch nut 230. In this case, the helically cut rod grooves 262 are configured to allow translation of the clutch nut protrusions 232. As the clutch nut 230 progresses along the length of the rod 260, the helical nature of the rod grooves 262 may produce relative rotation between the clutch nut 230 and the rod 260. Of course, embodiments of the claimed invention may not be limited to this example. Other various methods of providing valve actuation may be within the scope of the claimed invention, such as a rack and pinion assembly, among others.

The switch assembly 50 may also comprise a resilient device 250, such as a spring, to bias the switching piston 210, clutch coupling 220, clutch nut 230, and clutch housing 240 in a direction towards the switching line 40. In the exemplary embodiment shown, the resilient device 250 may press against a flange located on the proximal side of the clutch coupling 220.

Figure 3:
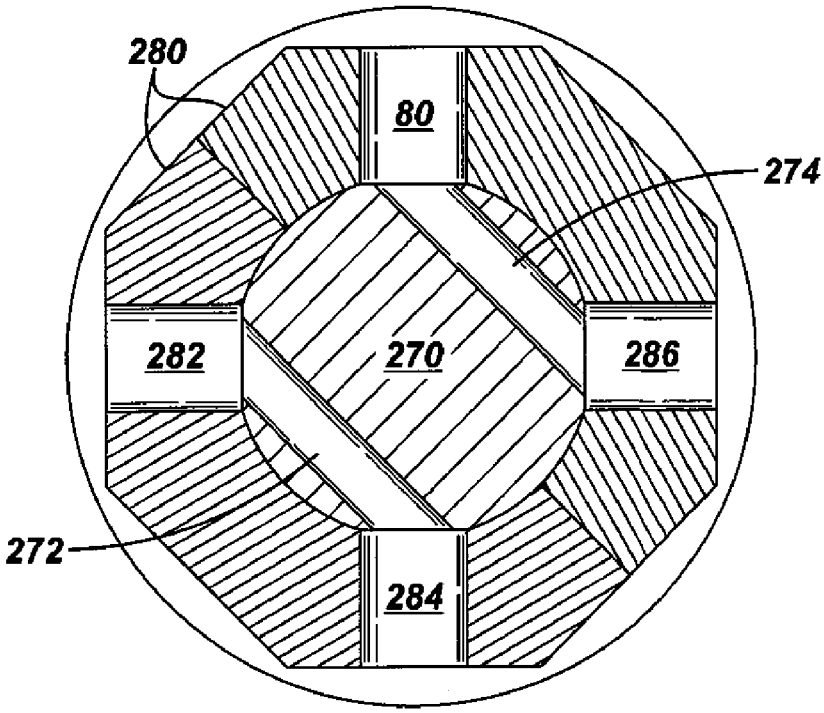
FIG. 3 is a front cross-sectional view of the flow paths in a ball valve of a switching assembly, in accordance with another embodiment of invention.

Turning now to FIG. 3, a cross-sectional view of an embodiment of a ball valve 270 within a directional housing 280 is shown. The directional housing 280 may be provided with a series of ports 282, 284, 286, and venting port 80. For example, port 282 may be coupled with the first operating line 60, port 284 may be coupled with the bypass line 30, port 286 may be coupled with the second operating line 70 (see FIG. 1). In all cases, the lines and passageways may be separate components such as control lines, or they may be integral to another component, such as an internal pathway. The terms are not limiting as there may be cases in which a control line couples two ports together in one embodiment while an internal passageway is used in place of a control line in another embodiment. Of course, combinations of control lines and passageways may also be used.

The ball valve 270 may comprise a first coupling passageway 272 and a second coupling passageway 274. The first coupling passageway 272 may couple together a first set of two of the ports, such as port 282 and port 284, allowing pressurized fluid to flow into a first chamber 92, Concurrently, the second coupling passageway 274 may couple together a second set of two other ports, such as port 286 and venting port 80, allowing fluid in second chamber 93 to exit the chamber. Together, the first and second sets may comprise a first configuration, while alternative sets of ports may comprise a second configuration. As configured, application of a pressurized fluid source would result in the actuating piston 90 moving to the right, as seen in FIG. 1.

An embodiment of the switching assembly 50 may function in the following manner. A single source of fluid pressure 5 may experience a rise in fluid pressure above a threshold amount. The pressure may be assumed to be equally applied to the switching line 40 and the bypass line 30. As the pressure rises in the switching line 40, the switching piston 210 may be moved to the right (as seen in FIG. 2A). Movement of the switching piston 210 may result in a movement of the clutch coupling 220 to the right within the clutch housing 240. The clutch coupling 220 may abut against the clutch nut 230, in some cases, due in part to the friction of the clutch nut protrusions 232 within the grooves 262 cut into the rod 260. The interacting coupling surface 226 may then engage the interacting clutch nut surface 236, rotatably fixing the clutch coupling 220 with regard to the clutch nut 230. Accordingly, the clutch coupling protrusions 222 interacting with grooves cut in the housing 200 effectively constrain the clutch nut 230 from rotating relative to the housing 200 as the switching piston 210 translates along the length of the housing 200.

As the clutch nut 230 is translated along the shaft of the rod 260, the helically cut grooves 262 engaging the clutch nut protrusions 232 result in the rotation of the rod 260 relative to the housing 200. The switching piston 210 may translate to a predetermined point within the housing 200, resulting in a predetermined amount of rotation for the rod 260. The rod 260 may be contained within the cavity 214 formed within the switching piston 210. The rotation of the rod 260 may result in a corresponding rotation of the ball valve 270. Accordingly, the first and second coupling passageways 272, 274, may be rotated into one configuration so as to couple the bypass line 30 with the second operating line 70 (via ports 284 and 286 respectively)(as a first set) and to couple the first operating line 60 (port 282) with the venting port 80 (as a second set). This allows fluid to enter into the second chamber 93 and exit from the first chamber 92. Accordingly, the actuating piston 90 may translate to the left as seen in FIG. 1.

When the single source of pressurized fluid 5 is relieved, the pressure of the fluid falls below a threshold amount and the bias of the resilient device 250 begins to move the clutch coupling 220 to the left. As the clutch coupling 220 is moved within the clutch housing 240, the interacting coupling surface 226 disengages from the interacting clutch nut surface 236. Therefore, the clutch nut 230 may no longer be rotatably fixed with respect to the housing 200. The switching piston 210, clutch coupling 220, clutch nut 230 and clutch housing 240 may all translate with regard to the rod 260, which is translatably fixed with regard to the housing 200. As the clutch nut 230 translates along the length of the rod 260, the clutch nut 230 is free to rotate in response to the interaction of the clutch nut protrusions 232 and the rod grooves 262. Accordingly, there is no significant rotative force applied to the rod 260 and the rod 260 may remain substantially fixed with regard to rotation relative to the housing 200. The switching piston 210 may travel to a starting position within the housing 200, ready for another cycle in which the actuating piston 90 may be moved in an opposite direction.

In some embodiments, spring ball indents may be used to releasably retain or guide the ball valve 270 into predetermined positions relative to the ball housing 280 and/or housing 200. Angled surfaces may be used in advance of the detents to bias the ball valve 270 into the proper position. In addition, the spring ball detents may provide another threshold level for the pressure in the system to pass in order to actuate the ball valve 270 away from a current position. Of course, other methods of biasing the ball valve 270 into the proper position may be used. Use of a method may help to prevent the accumulation of error during repeated cycling of the switch assembly 50.

While the invention has been disclosed with respect to a limited number of embodiments, those skilled in the art, having the benefit of this disclosure, will appreciate numerous modifications and variations there from. It is intended that the appended claims cover such modifications and variations as fall within the true spirit and scope of the invention.

What is claimed is:

1. A switching apparatus, comprising:

a housing configured to contain a switching piston actuated by a fluid pressure source;

a switching valve comprising a first and second coupling passageway;

a switching valve housing coupled with the switching valve and comprising four ports;

wherein the switching piston actuates the switching valve, alternating the coupling between a first configuration in which the four ports are communicatively coupled into two sets of ports via the first and second coupling passageways, and a second configuration in which the four ports are communicatively coupled into an alternate two sets of ports via the first and second coupling passageways;

wherein the first configuration configures the fluid pressure source to actuate a downhole tool in a first manner and the second configuration configures the fluid pressure source to actuate the downhole tool in a second manner.

2. The switching apparatus as recited in claim 1, wherein the first configuration couples the first port to the second port and the third port to the fourth port and the second configuration couples the first port to the fourth port and the second port to the third port.

3. The switching apparatus as recited in claim 2, wherein the first and third ports are configured to respectively couple with a first and second operating line, and the second and fourth ports are configured to be respectively coupled with a venting passageway and a bypass line.

4. The switching apparatus as recited in claim 1, wherein the switching valve is a ball valve.

5. The switching apparatus as recited in claim 1, wherein the switching piston rotates the switching valve during at least a portion of a switching piston cycle.

6. The switching apparatus as recited in claim 1, further comprising:

a clutch assembly;

a rod coupled to the switching valve;

wherein movement of the switching piston in one direction engages the clutch assembly and rotates the rod, thereby actuating the switching valve and alternating the coupling between the first configuration and the second configuration; and wherein movement of the switching piston in a direction opposite to the one direction disengages the clutch assembly.

7. The switching apparatus as recited in claim 6, wherein the clutch assembly comprises:

a clutch coupling;

a clutch nut;

wherein movement of the switching piston in the one direction engages the clutch coupling with the clutch nut, and movement of the switching piston in the direction opposite to the one direction disengages the clutch coupling with the clutch nut.

8. A control system configured for actuating a downhole tool comprising:

a fluid pressure source split into a bypass line and a switching line;

a switching assembly communicably coupled to the switching line comprising:

a switching piston;

a switching valve comprising a first and second coupling passageway;

a switching valve housing coupled with the switching valve and configured to be coupled to a first and second operating line, a venting port, and the bypass line;

wherein the switching piston actuates the switching valve, alternating the coupling of the first and second operating lines with the venting port and the bypass line via the first and second coupling passageways;

wherein coupling the first operating line with the bypass line configures the control system to actuate the downhole tool in a first manner and coupling the second operating line with the bypass line configures the control system to actuate the downhole tool in a second manner.

9. The control system as recited in claim 8, wherein the switching valve is a ball valve.

10. The control system as recited in claim 8, wherein the switching piston rotates the switching valve through a predetermined rotation to alternate the coupling of the first and second operating lines.

11. The control system as recited in claim 8, wherein the switching assembly further comprises:

a clutch assembly;

a rod coupled to the switching valve;

wherein movement of the switching piston in one direction engages the clutch assembly and rotates the rod, thereby actuating the switching valve and alternating the coupling of the first and second operating lines with the venting port and the bypass line via the first and second coupling passageways;

wherein movement of the switching piston in a direction opposite to the one direction disengages the clutch assembly.

12. The control system as recited in claim 11, wherein the clutch assembly comprises:

a clutch coupling;

a clutch nut;

wherein movement of the switching piston in the one direction engage the clutch coupling with the clutch nut, and movement of the switching piston in the direction opposite to the one direction disengages the clutch coupling with the clutch nut.

13. The switching apparatus as recited in claim 8, wherein the downhole tool is a valve.

14. The switching apparatus as recited in claim 13, wherein the valve is a formation isolation valve.

15. The switching apparatus as recited in claim 8, wherein the first and second operating lines are configured to be communicably coupled to either side of an actuating piston of the downhole tool.

16. A method for controlling a downhole tool coupled to a first operating line and a second operating line comprising the steps of:

supplying a single source of pressure to a pressure splitting device to produce a first pressure source and a second pressure source;

actuating a switching device with the first pressure source, thereby altering a communicable coupling between the second pressure source and one of the first operating line or the second operating line;

actuating the downhole tool with the second pressure source via the one of the first operating line or the second operating line;

relieving the single source of pressure;

wherein actuating via the first operating line operates the downhole tool in a first manner, and actuating via the second operating line operates the downhole tool in a second manner, wherein actuating the switching device further comprises: applying the first pressure source to a switching piston resulting in the switching piston translating along an interior of a switching housing; and rotating a ball valve in response to the translation of the switching piston thereby altering the coupling between the second source and one of the first operating line or the second operating line.

17. The method as recited in claim 16, wherein the downhole tool is a valve.

18. The method as recited in claim 17, wherein the valve is a formation isolation valve.

19. The method as recited in claim 16, wherein the method further comprises:

venting via one of the first operating line or the second operating line not coupled with the second pressure source.

* * * * *